US012601576B2

(12) United States Patent
Smith

(10) Patent No.: US 12,601,576 B2
(45) Date of Patent: Apr. 14, 2026

(54) SINTER BONDED PROJECTILE

(71) Applicant: Roger J. Smith, Barlett, IL (US)

(72) Inventor: Roger J. Smith, Barlett, IL (US)

( * ) Notice: Subject to any disclaimer, the term of this patent is extended or adjusted under 35 U.S.C. 154(b) by 0 days.

(21) Appl. No.: 18/599,183

(22) Filed: Mar. 7, 2024

(65) Prior Publication Data

US 2025/0283705 A1 Sep. 11, 2025

(51) Int. Cl.

| | |
|---|---|
| ***F42B 12/74*** | (2006.01) |
| ***B22F 5/00*** | (2006.01) |
| ***F42B 33/02*** | (2006.01) |

(52) U.S. Cl.

CPC ..... *F42B 12/74* (2013.01); *B22F 5/00* (2013.01); *F42B 33/025* (2013.01); *B22F 2301/10* (2013.01)

(58) Field of Classification Search

CPC ..... F42B 12/74; F42B 12/76; F42B 12/78; F42B 12/80; F42B 12/82; B22F 5/00; B22F 2301/10

See application file for complete search history.

(56) References Cited

U.S. PATENT DOCUMENTS

| | | | | |
|---|---|---|---|---|
| 6,074,454 | A | 6/2000 | Abrams | |
| 9,188,416 | B1 | 11/2015 | Hash | |
| 10,309,756 | B2 | 6/2019 | Sloff | |
| 2005/0268809 | A1 | 12/2005 | Smith | |
| 2006/0288897 | A1* | 12/2006 | Williams | F42B 12/56 102/364 |
| 2017/0336186 | A1 | 11/2017 | Smith | |

* cited by examiner

*Primary Examiner* — Jonathan C Weber
(74) *Attorney, Agent, or Firm* — Peter A Borsari

(57) ABSTRACT

The invention of the present subject matter relates to a sinter bonded projectile comprising a core component and a copper component which has been sintered in such a manner to form a solid mass over the core. More particularly, the invention of the present subject matter provides a core component to which a copper component is melted at a temperature sufficient that it penetrates into the pores and geometry of the core component under compression due to thermal shrinkage, resulting in a tightly bonded solid mass containing no voids. The invention of the present subject matter also provides a process for manufacturing the projectile.

7 Claims, 3 Drawing Sheets

SINTER BONDED PROJECTILE

PRIOR ART

Projectiles and in particular bullets for ammunition are well known in the prior art. Traditionally, bullets have been manufactured with a metallic jacket on the outside of the core, typically a lead core, having a tungsten tip placed at the end of the core and then wrapping a copper jacket around the core. The copper jacket acts as a barrier to the inner lead core and the barrel and ensures the rifling of the barrel.

Advancements have been made in recent years to manufacturing bullets that are lead free. For example, U.S. Patent Application Publication 2005-0268809 AI to Smith relates to a projectile comprising a compacted and sintered mixture of a plurality of tungsten particles and a plurality of iron particles. PCT Application WO 96/32439 to Mullins provides a lead-free frangible ammunition made from 85 to 93% by weight of powders of copper, tungsten, ceramic, bismuth, stainless steel or bronze or blends/alloys thereof, the powder being present in a polyester matrix with a small amount of ionomer. In U.S. Pat. No. 9,188,416 BI to Hash et al. discloses a lead-free projectile composed of iron and copper melted at a predetermined ratio and rapidly quenched to yield a fine-grained microstructure with uniformly distributed copper and iron phases. In addition to the iron and copper melt, Hash et al. contemplate the use of other alloys as well as other additives to produce frangible projectiles.

PCT Application WO 01-18453 AI to Nilsson is directed to protecting the bore of a barrel against the exposed projectile material by providing a projectile comprising a body or core of sintered metal powder and having a sintered metal powder surface that faces towards the rifling in the bore of a firearm and co-acts therewith. Nilsson proposes that the sintered metal powder surface of the projectile have a porosity of 5 to 25% to restrict friction of the projectile through the bore of the barrel. In one embodiment, the projectile comprises 90-95% by weight of copper and 5-10% by weight of zinc and/or tin.

In addition to the progression away from lead bullets, there have also been some progression away from the use of jacketed bullets. For instance, U.S. Patent Application Publication 2017-0336186 AI to Smith provides a non-jacketed bullet having a sintered body and a sintered projectile tip which is inserted into the sintered body. Smith contemplates that the sintered body comprises at least one of copper, nickel, tin, zinc or any combination thereof. In U.S. Pat. No. 10,309,756 B2 to Sloff et al., a metal bullet comprising a compacted mixture of copper powder. Similarly, U.S. Pat. No. 6,074,454 to Abrams et al. provides a lead-free frangible bullet made from copper or copper alloy powders that are pressed and sintered to a desired level of frangibility. However, none of the afore-mentioned patents disclose or contemplate a projectile having a core member which has been sintered with copper to form a tightly bonded solid mass containing no voids and which is non-frangible.

BACKGROUND OF THE INVENTION

Traditionally, bullets have been manufactured with a lead core, placing a tungsten tip at the end of the core, and then wrapping a copper jacket around the core. Lead has been used in the manufacture of projectiles such as bullets due to its density, malleability, and easily melted and cast at low temperatures. The density of the lead core enables it to "fly better", meaning with greater velocity. In recent years, there has been movement away from the use of lead cores in bullets due to its known toxicity, government regulation and the necessity of the copper jacket. Jacketing the lead core ensures the rifling of the gun barrel. While the copper jacket acts as a barrier between the lead core and the barrel, due to the relatively low melting point of lead, when a lead core bullet is fired above a certain velocity, the lead melts and vaporizes, thereby leaving deposits in the barrel causing lead build up, The copper jacket, which has a higher melting point then lead, allows higher muzzle velocities without depositing significant amounts of lead or damaging the bore. A significant drawback to the use of a copper jacket is that voids are created between the lead core and the jacket itself. Such voids tend to decrease the velocity, accuracy, and penetrating power of the bullet.

Accordingly, there has been attempts to manufacture projectiles without lead cores and without the need for wrapping a jacket about the core. However, many of these attempts have resulted in lesser velocity, decrease in penetrating power, increased frangibility, and lessened accuracy.

SUMMARY OF THE INVENTION

The invention of the present subject matter relates to a sinter bonded projectile comprising a core component and a copper component which has been sintered in such a manner to form a solid mass over the core. More particularly, the invention of the present subject matter provides a core component to which a copper component is melted at a temperature sufficient the it penetrates into the pores and geometry of the core component under compression due to thermal shrinkage, resulting in a tightly bonded solid mass containing no voids. The invention of the present subject matter also provides a process for manufacturing the projectile.

Accordingly, it is an object of the present subject matter to provide a sinter bonded projectile that is free of a lead core and does not require that the core be jacketed.

It is another object of the present subject matter to provide a sinter bonded projectile that is a has greater accuracy and higher penetration when compared to a conventional projectile.

It is a further object of the present subject matter to provide a sinter bonded projectile in the form of a tightly bonded solid mass containing no voids.

It is an additional object of the present subject matter to provide a sinter bonded projectile comprising a tungsten carbide core and a copper component which have been sintered to form a tightly bonded solid mass containing no voids.

It is still another object of the present subject matter to provide a sinter bonded projectile that impacts with greater force due an being an integrated mass.

It is a yet another object of the present subject matter to provide a sinter bonded projectile which demonstrates greater accuracy from better centering of the core component.

It is a further object of the present subject matter to provide a process for manufacturing a sinter bonded projectile comprising a core component and a copper component which have been sintered to form a tightly bonded solid mass containing no voids. least one specification heading is required.

DETAILED DESCRIPTION OF THE INVENTION

In the following description, like reference numbers are used to identify like elements. Furthermore, the drawings are intended to illustrate major features of exemplary embodiments in a diagrammatic manner. The drawings are not intended to depict every feature of every implementation nor relative dimensions of the depicted elements and are not drawn to scale. In the following description, numerous specific details are set forth to clearly describe various specific embodiments disclosed herein. One skilled in the art, however, will understand that the presently claimed invention may be practiced without all the specific details discussed below. In other instances, well known features have not been described so as not to obscure the invention.

The sinter bonded projectile of the present invention comprises a core component and a copper component which have been sintered in such a manner to form a solid mass over the core. More particularly, the core component can be composed of a variety of materials with specialty type properties to enhance velocity, impact, ductility, hardness, penetration, and accuracy. In a preferred embodiment of the present invention, the core component is tungsten carbide. More preferably, the core component is a tungsten carbide pin. Other materials suitable for use as the core material include, for example, monel, nickel, tungsten, steel and stainless steel. However, will be understood to those skilled in the art that these are examples of other suitable materials and not limited thereto.

The copper component of the sinter bonded projectile of the present subject matter can be in the form of a copper powder or copper wire. In a preferred embodiment, the copper content is relatively high, for example in the range of at least about 98.5% by weight to about 100% by weight. However, it is contemplated to be within the scope of the present subject matter that the copper component can be in the form of a copper alloy having a copper content lower than 98.5% by weight. More preferably, the copper component does not contain any additives that would enhance frangibility.

The sinter bonded projectile is formed by sintering and melting copper powder around and in the core to form one solid mass. The temperature of the sintering must be sufficient such that the copper is melted and penetrates into the pores and geometry of the core under compression due to thermal shrinkage. This sintering results in a tightly bonded solid mass containing no voids. The sintering temperature will be dependent in part on the amount of copper in the copper component. Preferably, the sintering temperature is in the range of between about 1300° F. and about 24S0° F. More preferably, the sintering temperature is in the range of between about 2000° F. to about 24S0° F.

Figure 1:
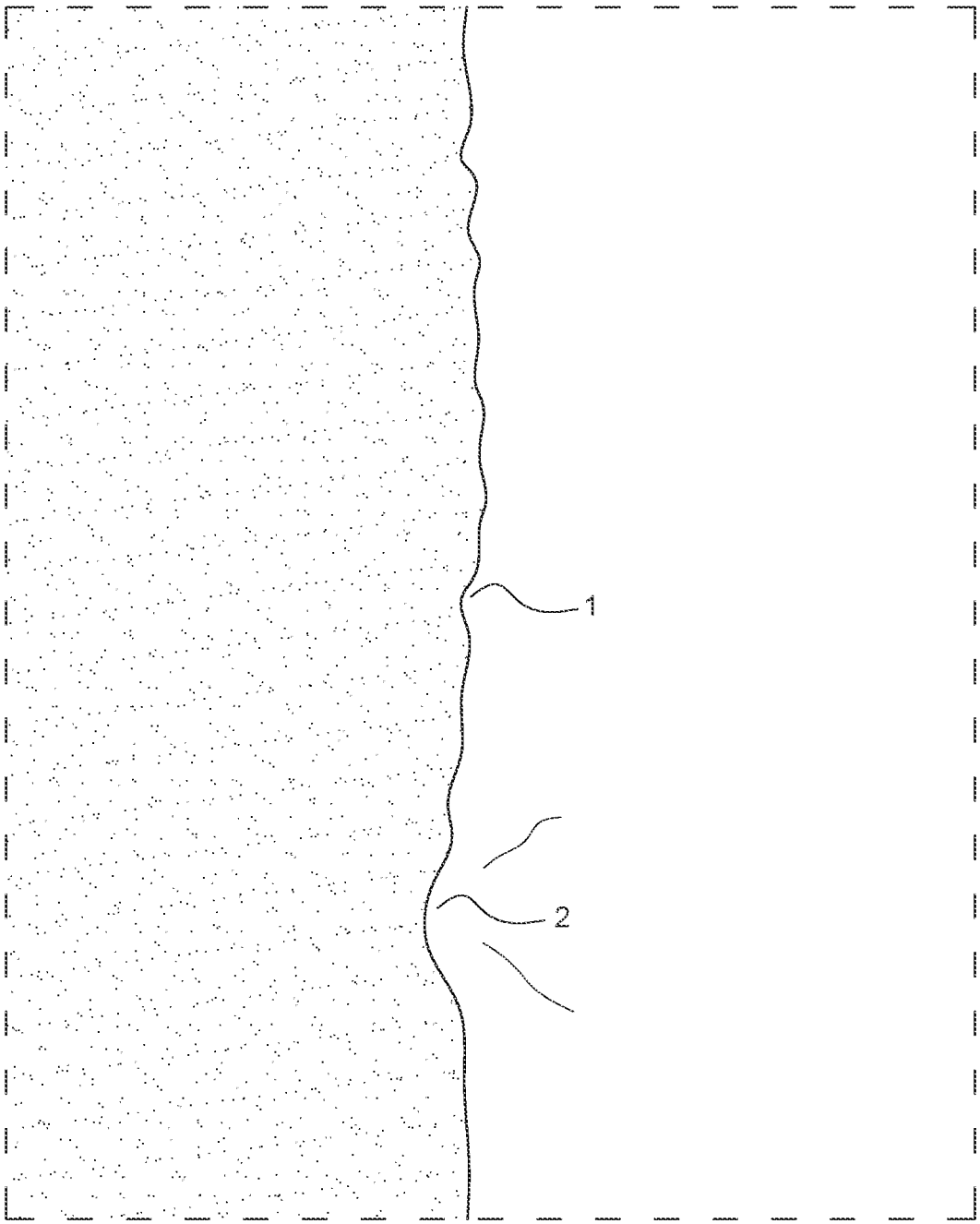
FIG. 1 shows a top view of the mold of the sinter bonded projectile.
Figure 2:
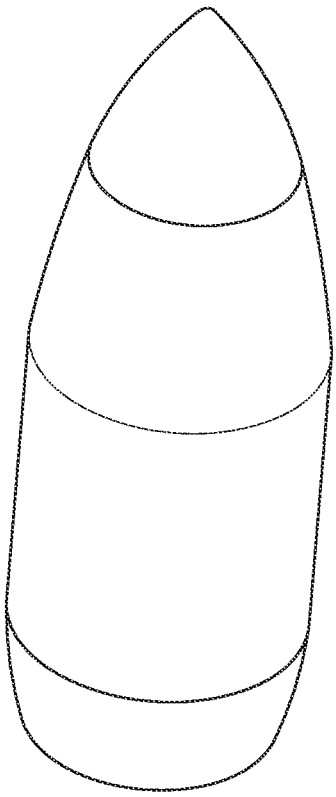
FIG. 2 shows a magnified view of the sinter bonded projectile.
Figure 3:
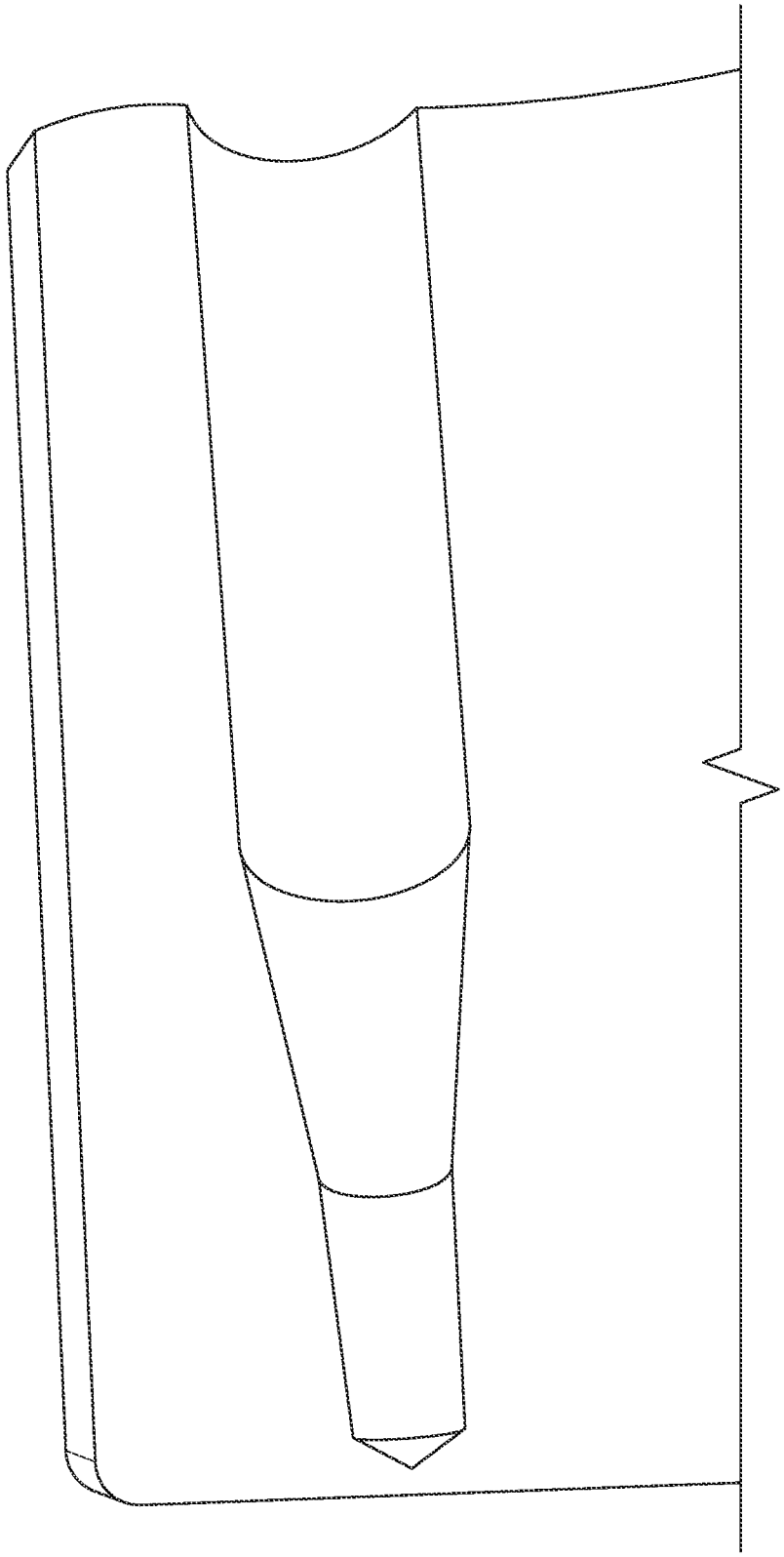
FIG. 3 shows a perspective view of the sinter bonded projectile.

In operation, a hole is drilled into a carbon block, suitable examples of which include a graphite mold or ceramic mold, and the core component is centered within the carbon block. FIG. 1 illustrates a top view of the carbon block. The hole with the centered core component is filled with the copper component. The carbon block is placed in an oven or blast furnace having an atmosphere protective element. The carbon block is then sintered at a temperature sufficient to melt the copper component in such a manner that the melted copper component penetrates into the pores and geometry of the core component. This sintering process results in the formation of a tightly bonded solid mass containing no voids. The carbon block is cooled and the tightly bonded solid mass is removed from the carbon block. The resulting cooled solid mass is placed on a lathe or similar device and machined into the desired shape and size as shown in FIG. 2 and FIG. 3. In this manner, a non-jacketed projectile is formed having a core component and an outer layer having the copper component.

It will be obvious to those skilled in the art that the desired size and shape of the sinter bonded projectile can be configured by altering the diameter of the hole drilled into the carbon block. It also will be obvious to those skilled in the art that altering the core component pin can change the grain weight and performance.

While several illustrative embodiments of the invention have been shown and described, numerous variations and alternative embodiments will occur to those skilled in the art. Such variations and alternative embodiments are contemplated and can be made without departing from the scope of the invention as defined in the appended claims.

The invention claimed is:

1. A sinter bonded projectile comprising a core component in the form of tungsten carbide and a copper component which is sintered around and into the core to form a tightly bonded solid mass containing no voids.

2. The sinter bonded projectile in accordance with claim 1, wherein said copper component is in the form of copper powder.

3. The sinter bonded projectile in accordance with claim 2, wherein said copper powder contains at least 98.5% by weight copper.

4. The sinter bonded projectile in accordance with claim 1, wherein said copper component is in the form of copper wire.

5. The sinter bonded projectile in accordance with claim 4, wherein said copper wire contains at least 98.5% by weight copper.

6. The sinter bonded projectile in accordance with claim 1, wherein said copper component is selected from the group consisting of copper powder and copper wire.

7. The sinter bonded projectile in accordance with claim 6 wherein said copper component contains at least 98.5% by weight copper.

* * * * *